US005230433A

United States Patent [19]

Hamilton et al.

[11] Patent Number: 5,230,433

[45] Date of Patent: Jul. 27, 1993

[54] ADULT FRIENDLY CHILD-RESISTANT ATTACHMENT FOR CONTAINERS USED TO STORE POTENTIALLY DANGEROUS MATERIALS

[75] Inventors: Peter W. Hamilton; Robert S. Dirksing, both of Cincinnati, Ohio; Reuben E. Oder, Florence, Ky.

[73] Assignee: The Procter & Gamble Company, Cincinnati, Ohio

[21] Appl. No.: 826,747

[22] Filed: Jan. 28, 1992

[51] Int. Cl.[5] ..... B65D 55/02

[52] U.S. Cl. ..... 215/221; 215/204; 215/211; 215/213; 215/216

[58] Field of Search ..... 215/204, 209, 211, 213, 215/216, 221

[56] References Cited

U.S. PATENT DOCUMENTS

| | | | |
|---|---|---|---|
| Re. 27,673 | 6/1973 | Landen . | |
| Re. 29,793 | 10/1978 | Pehr | 222/153 |
| 3,77,924 | 12/1973 | Kayser et al. . | |
| 2,061,214 | 11/1936 | Sentman . | |
| 2,847,139 | 8/1958 | Christiansson et al. . | |
| 2,964,207 | 12/1960 | Towns . | |
| 3,019,931 | 2/1962 | Thornton . | |
| 3,101,856 | 8/1963 | Whiteman, Jr. . | |
| 3,110,411 | 11/1963 | Golde . | |
| 3,172,929 | 3/1965 | Santelli . | |
| 3,185,333 | 5/1965 | Sharp . | |
| 3,200,979 | 8/1965 | Powers . | |
| 3,233,769 | 2/1966 | Jessop . | |
| 3,306,482 | 2/1967 | Tuuri . | |
| 3,394,829 | 7/1968 | Peterson . | |
| 3,399,796 | 9/1968 | Steiner . | |
| 3,403,803 | 10/1968 | Markowitz . | |
| 3,445,022 | 5/1969 | Cilluffo . | |
| 3,472,409 | 10/1969 | Slack et al. . | |
| 3,531,008 | 9/1970 | Achabal et al. . | |
| 3,547,295 | 12/1970 | Landen | 215/221 |
| 3,563,368 | 2/1971 | McHugh . | |
| 3,567,057 | 3/1971 | Landen . | |
| 3,593,879 | 7/1971 | Gach . | |
| 3,627,160 | 12/1971 | Horvath . | |

(List continued on next page.)

OTHER PUBLICATIONS

Injection-blow molding by Christopher Irwin, Modern Plastics Encyclopedia 1988 pp. 205-206.

*Primary Examiner*—Allan N. Shoap
*Assistant Examiner*—Vanessa Caretto
*Attorney, Agent, or Firm*—E. Kelly Linman; Dean L. Garner

[57] ABSTRACT

A child resistant attachment for containers used for storing and dispensing potentially dangerous materials, such as medicament tablets or the like, the attachment being resistant to opening by children but readily openable by adults, particularly adults having impaired manual dexterity of their hands and/or fingers. In a particularly preferred embodiment, the attachment comprises a finish portion including thread ring with an integrally molded annular tab ring or collar generally concentric to the thread ring and a closure which is releasably secured to the thread ring by means of complementary screw threads. The tab ring or collar preferably includes a pair of resiliently deformable spring-like pushtabs containing vertical extensions which engage interlocking pawls on the innermost surface of the closure skirt when the closure is fully assembled onto the finish portion. To remove the closure, the opposed pushtabs must be depressed prior to applying unscrewing torque to the closure to disengage the pushtab extensions from the interlocking pawls on the closure. In a particularly preferred embodiment, the finish portion of the child resistant attachment of the present invention is integrally molded with the container in a ready to use configuration without the need for additional assembly or molding operations. Methods for producing the child resistant attachment and child resistant packages employing it are also disclosed.

15 Claims, 11 Drawing Sheets

U.S. PATENT DOCUMENTS

| | | | |
|---|---|---|---|
| 3,656,646 | 4/1972 | Taylor . | |
| 3,667,637 | 6/1972 | Bagguley et al. . | |
| 3,700,133 | 10/1972 | Bagguley . | |
| 3,744,655 | 7/1973 | Nixdorff, Jr. . | |
| 3,757,979 | 9/1973 | Berghahn . | |
| 3,768,681 | 10/1973 | Dougherty, Sr. | 215/221 |
| 3,773,203 | 11/1973 | Grimaldi et al. . | |
| 3,794,200 | 2/1974 | Marks . | |
| 3,794,201 | 2/1974 | Galer . | |
| 3,811,589 | 5/1974 | Thornton et al. . | |
| 3,817,416 | 6/1974 | Costa | 215/213 |
| 3,826,394 | 7/1974 | Stull . | |
| 3,828,958 | 8/1974 | Shannon | 215/221 |
| 3,830,392 | 8/1974 | Kessler et al. . | |
| 3,848,780 | 11/1974 | Stull | 222/546 |
| 3,865,267 | 2/1975 | Morris | 215/206 |
| 3,870,182 | 3/1975 | Georgi | 215/220 |
| 3,877,597 | 4/1975 | Montgomery et al. | 215/221 |
| 3,881,625 | 5/1975 | Landen | 215/221 |
| 3,882,213 | 5/1975 | Uhlig | 264/535 |
| 3,884,379 | 5/1975 | Landen | 215/221 |
| 3,891,110 | 6/1975 | Gach | 215/216 |
| 3,892,326 | 7/1975 | Schneible | 215/221 |
| 3,894,647 | 7/1975 | Montgomery . | |
| 3,895,730 | 7/1975 | Koehne et al. | 215/216 |
| 3,895,731 | 7/1975 | Coursaut | 215/218 |
| 3,900,123 | 8/1975 | Darlington | 215/216 |
| 3,901,400 | 8/1975 | Westfall | 215/221 |
| 3,902,620 | 9/1975 | McIntosh | 215/209 |
| 3,917,097 | 11/1975 | Uhlig | 215/216 |
| 3,954,200 | 5/1976 | Willis | 215/31 |
| 3,968,871 | 7/1976 | Briscoe | 206/1.5 |
| 3,989,152 | 11/1976 | Julian | 215/216 |
| 3,993,208 | 11/1976 | Ostrowsky | 215/216 |
| 3,993,209 | 11/1976 | Julian | 215/216 |
| 4,002,259 | 1/1977 | Geiser | 215/216 |
| 4,036,385 | 7/1977 | Morris | 215/209 |
| 4,061,239 | 12/1977 | Tasseron | 215/221 |
| 4,076,071 | 2/1978 | Rosenkranz et al. | 264/535 |
| 4,079,104 | 3/1978 | Dickson et al. | 264/25 |
| 4,099,639 | 7/1978 | Boxer et al. | 215/209 |
| 4,103,797 | 8/1978 | Morris | 215/209 |
| 4,138,028 | 2/1979 | Price et al. | 215/216 |
| 4,141,461 | 2/1979 | LaChance | 220/253 |
| 4,144,983 | 3/1979 | Pauls et al. | 215/216 |
| 4,149,646 | 4/1979 | Julian | 215/216 |
| 4,154,353 | 5/1979 | Hoo | 215/209 |
| 4,204,615 | 5/1980 | McCarthy | 222/153 |
| 4,223,794 | 9/1980 | Morris | 215/220 |
| 4,261,478 | 4/1981 | Summers | 220/270 |
| 4,280,859 | 7/1981 | Thompson | 156/73.5 |
| 4,285,437 | 8/1981 | Morris | 215/220 |
| 4,331,247 | 5/1982 | Mumford | 215/216 |
| 4,335,823 | 6/1982 | Montgomery et al. | 215/206 |
| 4,337,869 | 7/1982 | Guinle | 215/201 |
| 4,353,473 | 10/1982 | Morris | 215/220 |
| 4,357,296 | 11/1982 | Hafele | 264/532 |
| 4,513,888 | 4/1985 | Curry | 215/213 X |
| 4,520,921 | 6/1985 | Vissing | 206/1.5 |
| 4,604,044 | 8/1986 | Hafele | 425/525 |
| 4,629,081 | 12/1986 | McLaren | 215/206 |
| 4,629,598 | 12/1986 | Thompson | 264/537 |
| 4,690,292 | 9/1987 | Henning | 215/201 |
| 4,752,013 | 6/1988 | Miller et al. | 215/216 |
| 4,771,910 | 9/1988 | Roy | 220/306 |
| 4,773,550 | 9/1988 | Ekkert | 215/206 |
| 4,782,965 | 11/1988 | Wassilieff | 215/220 |
| 4,782,966 | 11/1988 | Thackrey | 215/230 |
| 4,836,408 | 6/1989 | Roy | 220/306 |
| 4,928,002 | 8/1990 | Thornock et al. | 215/221 |
| 5,033,634 | 7/1991 | Batchelor et al. | 220/281 |
| 5,038,454 | 8/1991 | Thornock et al. | 29/451 |

ADULT FRIENDLY CHILD-RESISTANT ATTACHMENT FOR CONTAINERS USED TO STORE POTENTIALLY DANGEROUS MATERIALS

TECHNICAL FIELD

The present invention has relation to a package for storing and dispensing materials which can be harmful, particularly if improperly ingested.

In a particularly preferred embodiment, the present invention has relation to an attachment for a container used for storing and dispensing medicament tablets and the like.

The present invention has further relation to such an attachment for a container which is resistant to opening by the majority of children coming in contact with it, yet which can be opened without undue difficulty by adults whose manual dexterity may, at least to a degree, be impaired.

The present invention has further relation to such an attachment for a container which can be inexpensively manufactured to facilitate disposal thereof once the contents have been completely dispensed from the package.

The present invention has still further relation to methods for manufacturing such an attachment and the resulting package.

BACKGROUND ART

Child resistant packaging is understood to be a great concept for preventing inadvertent access by children to potentially dangerous materials such as medications. However, inclusion of the child resistant feature adds cost and, all to often, difficulty and frustration for the adult user when attempting to open the package.

Because of deteriorating health, elderly persons tend to rely on medication more than the average person. The elderly may also tend to have impaired manual strength and dexterity. Due to the difficulty in opening child resistant medicine packages which are currently in widespread use, many elderly persons request a non-child resistant package substitute. Alternatively, when medications are purchased in child resistant packages by older adults, the child resistant package is oftentimes not reclosed in order to defeat the child resistant feature. As a result, a large percentage of child poisonings occur in the homes of such elderly adults, e.g., grandparents.

The aforementioned problems are generally recognized in the packaging industry, particularly the pharmaceutical industry. Attempts to deal with these problems are also disclosed in the patent literature. For example, U.S. Pat. No. 3,993,208 issued to Ostrowsky on Nov. 23, 1976 discloses a safety closure means wherein the shoulder on a container is formed with a pair of diametrically positioned locking lugs. The mating closure is formed of thermoplastic material and has a top end wall and a depending annular inner wall in addition to a depending outer annular skirt spaced from the inner wall. The inner wall includes threaded means for engaging the neck of the container to secure the cap to the container in a closed position. The outer skirt of the cap has a pair of diametrically positioned radially extending locking lugs adjacent the lower end of the skirt. The cap locking lugs are adapted to pass inwardly of the container locking lugs and to be compressed radially inwardly when the cap is rotated to a cap closing position.

As the cap lugs move past the container locking lugs, the cap lugs are released from their compressed condition so that they extend outwardly beyond the engaging edges of the container locking lugs. This prevents the closure from being unscrewed until the outer skirt of the closure is manually squeezed radially inwardly adjacent the cap locking lugs to permit them to clear engagement with the edges of the container lugs as the cap is unscrewed from the container.

Under normal in use conditions, removal of the closure of Ostrowsky requires squeezing the outer skirt of the closure sufficiently to disengage the lugs on the container and simultaneously unscrewing the closure with the same hand used to apply the squeezing force. This may be difficult, particularly for elderly persons who may have impaired manual dexterity and strength.

In addition, the closure of Ostrowsky visually reveals how the interlocks must be overcome in order to remove the closure. A child having sufficient strength to depress the closure skirt may have sufficient intellect to defeat the interlock and remove the closure.

Another attempt to overcome the aforementioned problems is disclosed in U.S. Pat. No. 4,520,921 issued to Vissing on Jun. 4, 1985. The Vissing patent discloses a semirigid type container having a cap portion with a special mating relationship. In the illustrated embodiment, the cap comprises a cylindrical portion with an enlarged upper edge to facilitate gripping. A hole, or a pair of holes, may be provided in the skirt of the cap. The mating container to which the cap is applied has a reduced thickness area with a protruding boss or a pair of bosses. The reduced thickness portion of the container deforms when pressure is applied to the pressure point so that the cap can slip over the container. When pressure is released from the pressure point the boss or bosses on the container are allowed to enter the mating hole or holes in the cap. If desired a tapered lead-in ramp can be used to seat the boss on the container in a mating hole in the cap. The cap is removed by squeezing the pressure point or points to disengage the boss or bosses on the container from the hole or holes in the cap.

A potential difficulty, from the standpoint of child resistance, is that a simple squeezing force applied about the periphery of the container could inadvertently lead to deformation of the pressure point or pressure points of the container of Vissing, thereby permitting complete removal of the cap without the need for deliberate action on the part of the person squeezing the container.

Still another prior art attempt to overcome the aforementioned problems is disclosed in commonly assigned U.S. Pat. No. 4,948,002 issued to Thornock et al. on Aug. 14, 1990. The Thornock et al. patent discloses a package comprising a bottle, a collar which is secured in place over the uppermost portion of the bottle and a closure which is secured to the finish portion of the bottle by means of complementary screw threads. The collar preferably includes a pair of spring-like pushtabs containing vertical extensions which engage interlocking teeth on the innermost surface of the closure skirt when the closure is fully assembled onto the bottle. To remove the closure, the opposed pushtabs must be manually depressed prior to applying unscrewing torque to the closure to disengage the pushtab extensions from the interlocking teeth on the closure. While the Thornock et al. patent discloses a package exhibiting highly improved child resistance without significantly impeding access by adults, the disclosed collar arrangement is not readily adaptable to commonly available bottles and vials, such as those typically used by pharmacists for dispensing prescription medications.

OBJECTS OF THE INVENTION

Accordingly, it is an object of the present invention to provide an improved child resistant attachment for a container which is resistant to opening by the majority of children coming in contact with the package and which at the same time can readily be opened by adults who may have impaired manual dexterity in their fingers due to conditions such as advancing age, arthritis, etc.

It is another object of the present invention to provide in one preferred embodiment such an improved child resistant attachment which, if molded as a separate unit, may be easily and reliably secured to commonly available vials and bottles.

It is still another object of the present invention in another preferred embodiment to provide such an attachment at such a low cost that the attachment can be integrally molded onto the vial or bottle such that the child resistant feature of the bottle or vial is complete in a single injection molding operation without the need for any further assembly operations to secure the attachment to the vial or bottle.

DISCLOSURE OF THE INVENTION

In a particularly preferred embodiment, the present invention comprises an attachment for a container used for storing and dispensing potentially dangerous materials, such as medicaments. The attachment preferably comprises a finish portion including a closure securement ring having threads on at least one of its surfaces with an integrally molded tab ring and a closure which is rotatably secured to the closure securement ring by means of complementary screw threads. The tab ring includes at least one, and preferably a pair of opposed spring-like pushtabs which include vertical extensions at their uppermost ends. The closure has a skirt which includes at least one, and preferably a pair of opposed interlocking pawls which resist unscrewing of the closure once the closure has been completely applied onto the finish portion unless the opposed pushtabs on the tab ring are depressed so as to disengage their vertical extensions from the interlocking teeth on the innermost surface of the closure skirt. The tab ring and pushtabs are preferably integrally molded in place in a ready to use configuration without additional assembly or molding operations.

Packages which include the attachment of the present invention are relatively easy to open for adults because the opposing pushtabs on the collar are normally squeezed between the thumb and index finger of one hand while a twisting motion is applied to unscrew the closure with the other hand. Because each pushtab must be depressed before an attempt is made to unscrew the closure, it is unlikely that a child merely grasping the collar about its periphery will simultaneously disengage the vertical extensions of both pushtabs from the interlocking teeth on the closure skirt at the same time he or she exerts the required unscrewing torque with the other hand.

In a particularly preferred embodiment, means may be provided to fasten attachments of the present invention to commonly available vials and bottles. Alternatively, the finish portion of the attachment of the present invention may, if desired, be injection molded onto a bottle or vial so that the child resistant feature is integral with the bottle or vial and requires no further assembly or molding to be operational.

BRIEF DESCRIPTION OF THE DRAWINGS

While the specification concludes with claims particularly pointing out an distinctly claiming the present invention, it is believed the present invention will be better understood from the following description in conjunction with the accompanying drawings in which:

DETAILED DESCRIPTION OF THE INVENTION

Figure 1:
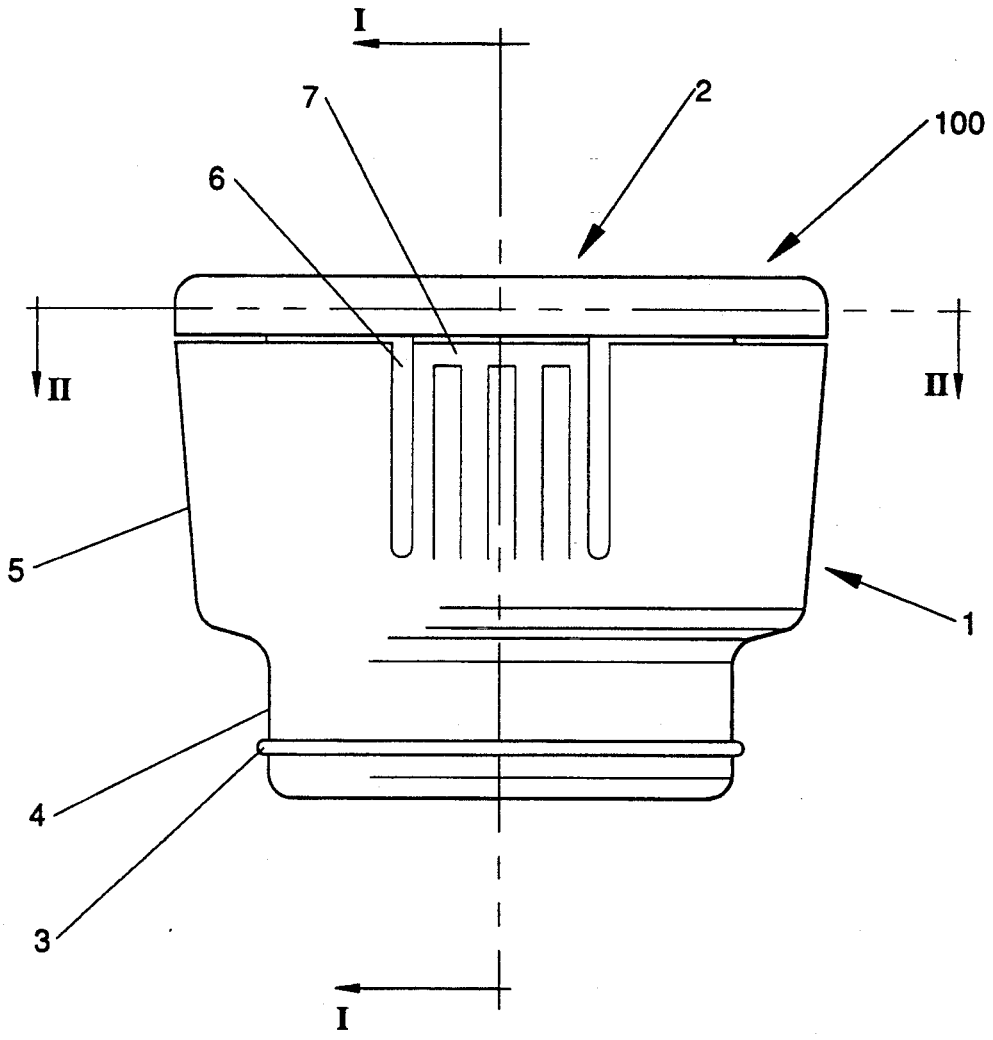
FIG. 1 is a side elevation view of a particularly preferred child resistant attachment of the present invention.

FIG. 1 shows a side view of a preferred child resistant attachment 100 of the present invention. Attachment 100 is particularly well suited for use in conjunction with typical cylindrical pharmaceutical bottles and vials to dispense pharmaceutical products, such as tablets. Attachment 100 comprises finish portion 1 and closure 2. Finish portion 1 and closure 2 are preferably injection molded of polypropylene, polystyrene, polycarbonate, or the like. Finish portion 1 comprises attachment ring 4 and tab ring or collar 5. Bead 3 on attachment ring 4 is used to secure attachment 100 to a pharmaceutical package (not shown). Tab collar 5 in interrupted by slots 6, thereby forming a pair of opposed cantilevered pushtabs 7, as shown in FIG. 2.

Figure 2:
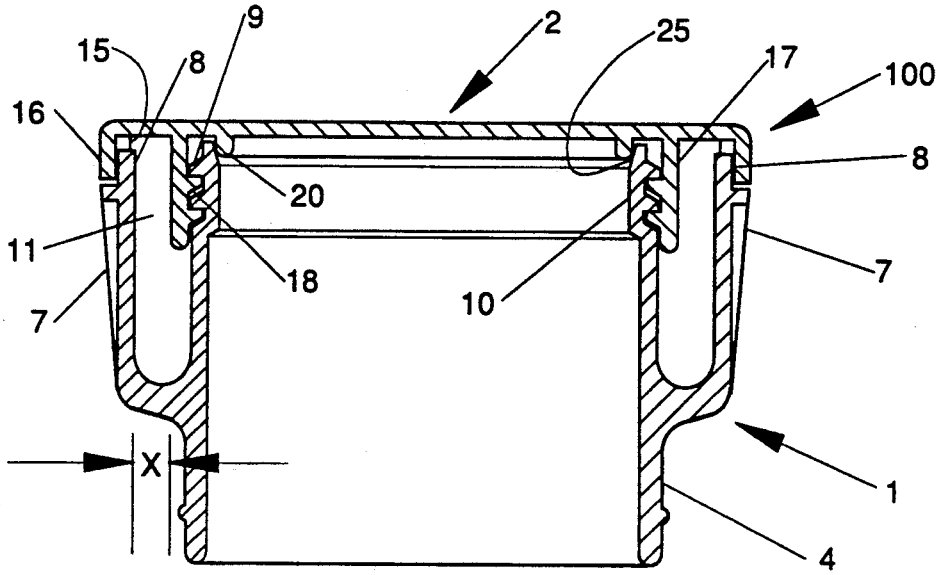
FIG. 2 is a cross-sectional view of the attachment shown in FIG. 1, said view being taken along section line I—I of FIG. 1.

FIG. 2 is a cross-sectional view of attachment 100 taken through section line I—I of FIG. 1. The closure securement ring includes first means for rotatably and releasably securing closure 2 to finish portion 1. In the illustrated embodiment, the first means comprises helical threads 9 on the outermost surface of thread ring 10. The closure 2 includes second means complementary to said first means for rotatably and releasably securing the closure to the closure securement ring. In the embodiment of FIG. 2, the second means comprises threads 18 on the innermost surface of thread collar 17 on closure 2. While any suitable releasable securement means, e.g., a combination of lugs or screw threads, can be employed to rotatably and releasably secure closure 2 onto finish portion 1, complementary screw threads 9 and 18, respectively, as shown in FIG. 2 are particularly preferred.

The threads 9 on the exterior surface of thread ring 10 are preferably double lead threads. The pitch of complementary threads 9 and 18 is preferably such that closure 2 is fully seated onto finish portion 1 with approximately 180° of rotation.

The collar 5, thread ring 10, and attachment ring 4 are preferably integrally molded and are generally concentric with one another. The top of each spring-like pushtab 7 has a vertical extension 8 which projects above the plane of the top edge of tab collar 5. The vertical extension 8 interlock with pawls 15 on the innermost surface of lock ring 16 of closure 2 when the closure 2 is fully threaded onto finish portion 1. A channel 11, formed between the inner surface of tab collar 5 and thread ring 10, accepts thread collar 17 when closure 2 is threaded onto finish portion 1.

During assembly of closure 2 onto finish portion 1, pawls 15 must rotate past vertical extensions 8. However, vertical extensions 8 interfere with rotation of pawls 15 and cause pushtabs 7 to be resiliently deflected inwardly. Gradual lead-in ramps on pawls 15 facilitate the deflection. In general it is preferred that the lead-in ramps exhibit a gradual inwardly directed taper so as to avoid a sudden increase in the reapplication torque required to fully seat the closure 2 onto the finish portion 1. If desired, the mating surfaces of vertical extensions 8 may also be profiled, as generally shown in the cross-sections of FIGS. 2A and 3A, to minimize the reapplication torque required to fully seat the closure 2 onto the finish portion 1 of the attachment 100. Both of these features help to ensure that the user will properly reapply the closure to restore child resistance to the package after the package has been opened.

Figure 2A:
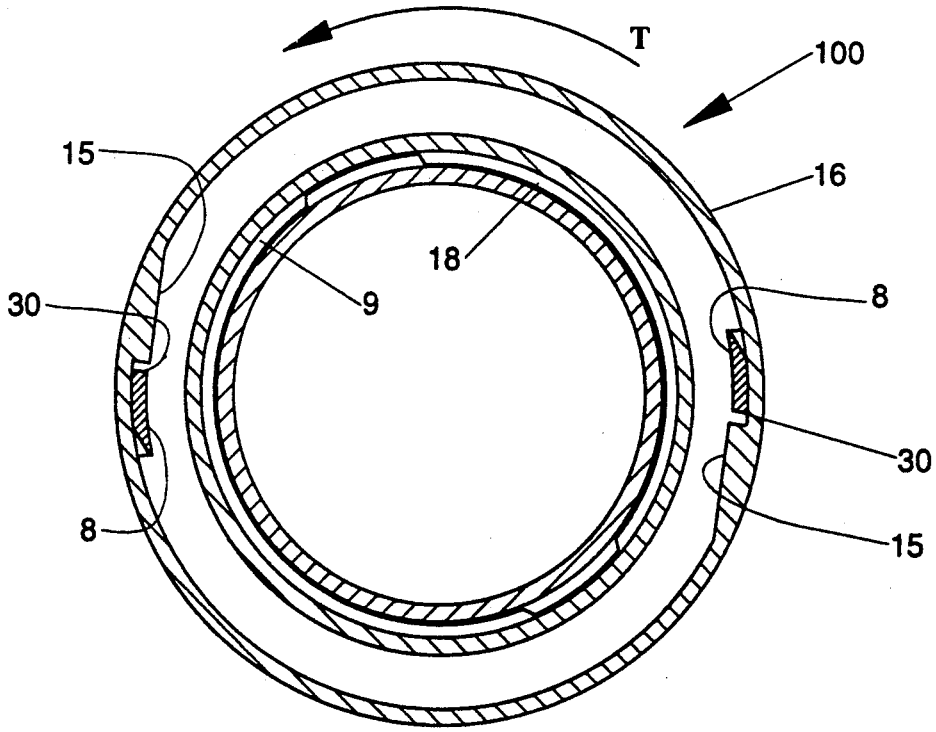
FIG. 2A is a cross-sectional view of the child resistant attachment of FIG. 1 taken along section line II—II of FIG. 1.

Continued rotation of closure 2 causes pawls 15 to clear the vertical extensions 8, thereby permitting vertical extensions 8 and pushtabs 7 to resiliently return to the latched condition shown in FIGS. 2 and 2A. The finish portion 1 may be molded so that the pushtabs 7 and vertical extensions 8 exhibit an unrestrained at rest position wherein the maximum exterior dimension, as measured across the opposed vertical extension 8 is substantially equal to or slightly less than the inside diameter of the closure lock ring 16, as measured in the area where pawls 15 are not present. Alternatively, the finish portion may be molded so that the vertical extensions 8 exhibit an unrestrained maximum exterior dimension which is somewhat greater than the inside diameter of the closure lock ring 16. In this situation, application of closure 2 to finish portion 1 results in preloading of the vertical extensions 8 against the interior surface of lock ring 16 when the closure 2 is fully seated, as shown in FIG. 2A.

The arrangement of threads 9 and 18 in conjunction with vertical extensions 8 and pawls 15 is such that latching of pawls 15 past vertical extensions 8 occurs nearly simultaneously with the seating of closure 2 onto finish portion 1, at which point seal lip 20 preferably engages finish taper 25 to form a seal. This is readily achievable, since the thread 9 is integrally molded with the finish portion 1 that includes the integrally formed pushtabs 7, vertical extensions 8 and finish taper 25 while the thread 18 is integrally formed with the closure 2 which includes pawls 15 and seal lip 20.

FIG. 2A is a cross-sectional view of attachment 100 taken along section line II—II in FIG. 1. With pushtabs 7 in the position shown in FIG. 2 and 2A, edges 30 of vertical extensions 8 impede counter-clockwise rotation of pawls 15 preventing attempts to reopen the attachment by rotating the closure 2 in the counter-clockwise direction indicated by the arrow "T".

Clearance in channel 11 between the outer surface of thread collar 17 and the inner surface of pushtabs 7 noted as dimension "X" in FIG. 2 permits sufficient inward deflection of pushtabs 7 from the position shown in FIG. 2 and 2A that the vertical extensions 8 will clear pawls 15 when the user concurrently depresses pushtabs 7 and applies an unscrewing torque in the direction of arrow "T" to the closure 2.

Figure 3:
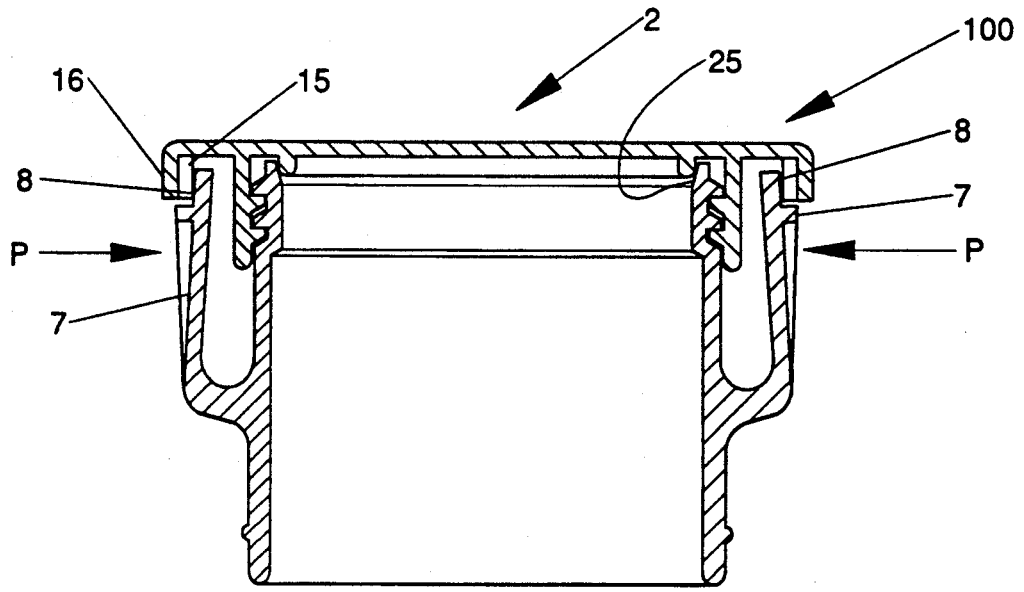
FIG. 3 is a cross-sectional view of the attachment shown in FIG. 1 with the pushtabs 7 in the depressed condition, said view being taken at a point corresponding to section line I—I of FIG. 1.

FIG. 3 is a view of attachment 100 taken at a point corresponding to section line I—I of FIG. 1, but with pushtabs 7 deflected inwardly. In order to unscrew closure 2 from finish portion 1 once the closure has been fully assembled, sufficient manual pressure must be applied to opposed pushtabs 7 in the direction indicated by arrows "P" in FIG. 3 such that the vertical extensions 8 on pushtabs 7 disengage the pawls 15 on the innermost surface of lock ring 16 of closure 2. The squeezing force required to depress pushtabs 7 is preferably great enough to be difficult for a child, yet low enough that people using the medication, such as arthritics, can readily depress the opposing pushtabs 7 while concurrently applying an unscrewing torque in the direction of arrow "T" in FIG. 3A to the closure 2. The preferred squeezing force "P" for the pushtabs 7 to provide child resistance without imposing undue difficulty for adults with impaired manual dexterity is believed to be within the range of about 0.5 pounds to about 5 pounds.

In addition, pushtabs 7 are preferably substantially flush with the outermost surface of tab ring or collar 5 when the closure 2 is fully secured in place so that simply grasping the collar about its entire periphery and squeezing is unlikely to permit both of the vertical extensions 8 on the opposed pushtabs 7 to become inadvertently disengaged from pawls 15 at the same time an unscrewing torque is being applied to the closure 2. Rather, a conscious decision to squeeze the opposing pushtabs 7 must be made by the user to initiate the opening process, and this must be accompanied by a concurrent application of unscrewing torque to the closure 2 to proceed further. This minimizes the chance that a child will be able to remove closure 2 simply by squeezing the entire periphery of tab collar 5 in his or her hand while trying to unscrew closure 2.

Figure 3A:
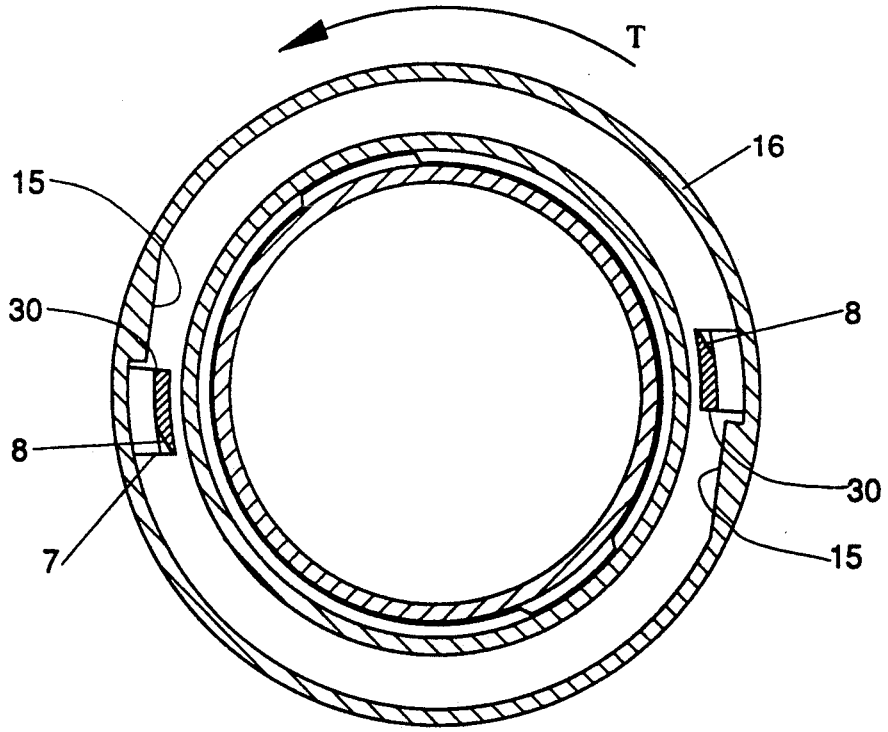
FIG. 3A is a cross-sectional view of the child resistant attachment of FIG. 1 with the pushtabs 7 in the depressed condition, said view being taken at a point corresponding to section line II—II of FIG. 1.

FIG. 3A is a cross-sectional view of attachment 100 taken at a point corresponding to section line II—II of FIG. 1, but showing the attachment 100 in the condition shown in FIG,. 3, i.e., with pushtabs 7 deflected inwardly. Vertical extensions 8 are thus shifted to a position wherein edges 30 no longer impede counter-clockwise rotation of pawls 15 on lock ring 16 in the direction indicated by the arrow "T". The user of child resistant attachment 100 is then able to further rotate closure 2 in a counter-clockwise direction, thereby causing the closure 2 to rise above vertical extensions 8 and release the engagement of threads 9 and 18 on thread ring 10 and thread collar 17, respectively. This permits closure 2 to be completely removed form finish portion 1.

Figure 4:
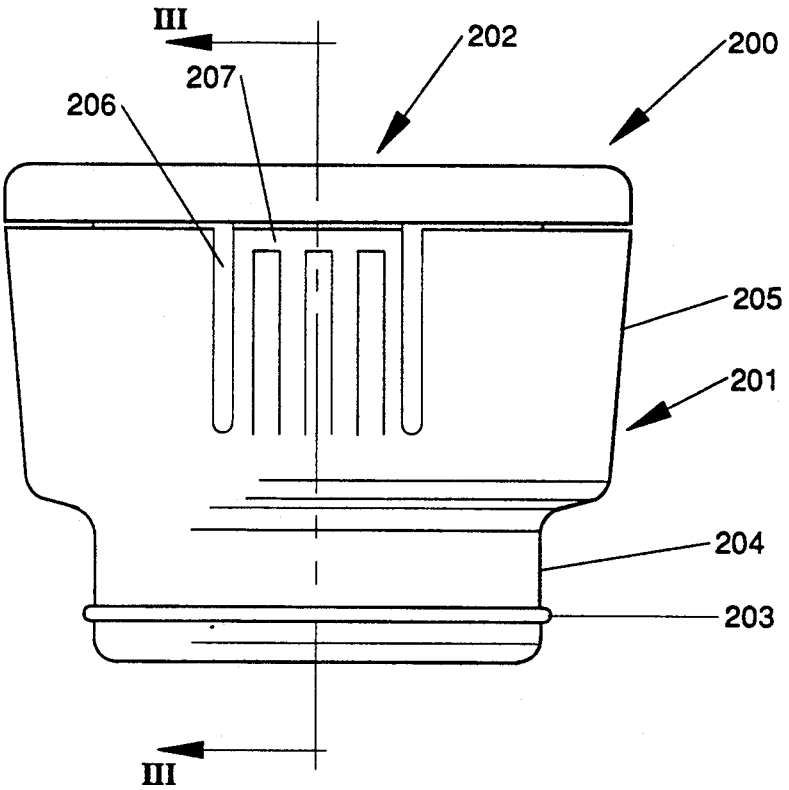
FIG. 4 is a side elevation view of an alternative embodiment of a child resistant attachment of the present invention.

FIG. 4 shows an alternative embodiment of a child resistant attachment 200 of the present invention. Attachment 200 comprises finish portion 201 and closure 202. Finish portion 201 further comprises attachment ring 204 and tab ring or collar 205. attachment ring 204 includes bead 203. Tab ring or collar 205 is interrupted by slots 206, thereby forming a pair of opposed cantilevered pushtabs 207.

Figure 4A:
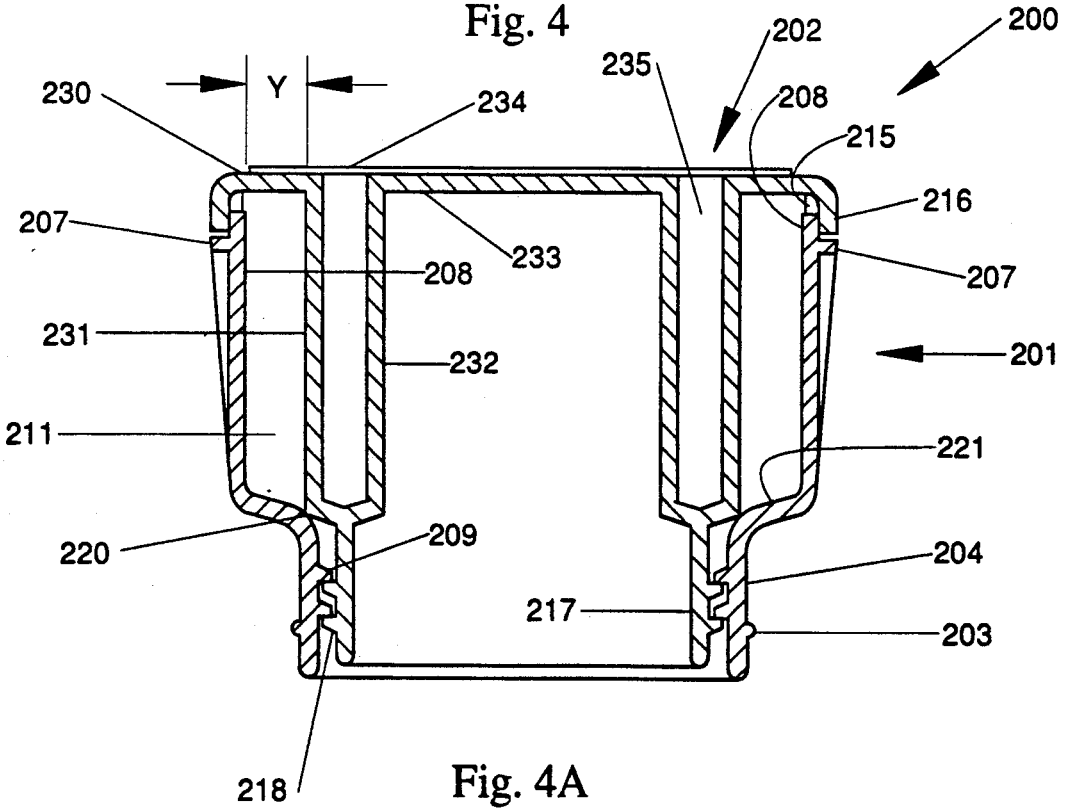
FIG. 4A is a cross-sectional view of the child resistant attachment shown in FIG. 4, said view being taken along section line III—III of FIG. 4.

FIG. 4A is a cross-sectional view of the child resistant container attachment 200 shown in FIG. 4, said view being taken along section line III—III in FIG. 4. Descending ring 231 extends inwardly from horizontal closure wall 230 and is joined to an outwardly extending ascending ring 232 at the upper end of thread ring 217. Ascending ring 232 supports horizontal closure wall 233. Descending ring 231 and ascending ring 232 are separated by a circular channel 235. Thread ring 217 extends downwardly from the juncture of descending ring 231 and ascending ring 232 and includes threads 218 about its lower outermost surface. Threads 218 are complementary to threads 209 on the interior surface of attachment ring 204. The top of each spring-like pushtab 207 has a vertical extension 208 which projects above the plane of the top edge of the tab ring or collar 205. The vertical extensions 208 interlock with pawls 215 on the innermost surface of lock ring 216 of closure 202 when the closure 202 is fully threaded onto finish portion 201 in substantially the same manner described with respect to the child resistant container attachment 100 shown in FIGS. 1-3A.

During assembly of closure 202 onto finish portion 201, pawls 215 must rotate past vertical extensions 208. However, vertical extensions 208 interfere with rotation of pawls 215 and cause pushtabs 207 to be resiliently deflected inwardly. Ramps on pawls 215 facilitate this deflection. Further rotation of closure 202 causes pawls 215 to clear vertical extensions 208, thereby permitting pushtabs 207 to resiliently return to the condition shown in FIGS. 4 and 4A. The arrangement of threads 209 and 218 in conjunction with vertical extensions 208 and pawls 214 is such that latching of pawls 215 past vertical extensions 208 occurs nearly simultaneously with the seating of closure 202 onto finish taper 221 to form a seal. Clearance in channel 211 between the outer surface of descending ring 231 and the inner surface of pushtabs 207, noted as dimension "Y" in FIG. 4A, permits sufficient inward deflection of pushtabs 207 to permit the vertical extensions 208 to clear pawls 215 when the user wants to apply sufficient unscrewing torque to remove the closure 202 from the finish portion 201.

With pushtabs 206 in the condition shown in FIGS. 4 and 4A, vertical extensions 208 impede counter-clockwise rotation of pawls 215 when attempting to remove closure 202. In order to unscrew closure 202 from finish portion 201 once the closure has been fully assembled onto the finish portion, sufficient manual pressure must be applied to pushtabs 207 such that the vertical extensions 208 on pushtabs 207 fully disengage the pawls 215 on the innermost surface of lock ring 216 of closure 202. The squeezing force required to depress pushtabs 207 is preferably great enough to be difficult for a child, yet low enough that people using the medication, such as arthritics, can readily depress the opposing pushtabs 207 while concurrently applying an unscrewing torque to the closure 202.

In addition, pushtabs 207 are preferably substantially flush with the outermost surface of tab collar 205 when the closure 202 and finish portion 201 are in a fully assembled condition so that simply grasping the ring about its entire periphery is unlikely to permit both of the vertical extensions 208 on pushtabs 207 from becoming inadvertently disengaged from pawls 215. Rather, a conscious decision to squeeze the opposing pushtabs must be made be the user to initiate the opening process. This minimizes the chance that a child will be able to remove closure 202 simply by squeezing the entire periphery of tab collar 205 in his or her hand while trying to unscrew closure 202.

In the particular attachment embodiment 200 shown in FIG. 4A, ascending ring 232 supports the closure's horizontal wall 233 such that the plane of the top surface of horizontal closure wall 233 is coincidental with the plane of the top surface of horizontal closure wall 230. Channel 235 between descending ring 231 and ascending ring 232 may, if desired, be covered, as by a label 234, so that a smooth uninterrupted surface is presented to the user of the package.

The particular configuration of closure 202 shown in FIG. 4A accommodates the internally threaded configuration of finish portion 201 while still providing a seal at seal lip 220 and finish taper 221 and a flush upper surface for closure 202. In addition, closure 202 is injection moldable as a single integral closure.

The vertical location of horizontal closure wall 233 may, if desired, be located at points lower on ascending ring 232 or even on thread ring 217. In the latter case, ascending ring 232 could, if desired, be eliminated altogether. Further, if a fluid tight seal at the junction of seal lip 220 and the finish taper 221 shown in FIG. 4A is not required, ascending ring 232 and descending ring 231 could both be eliminated, horizontal closure wall 230 could be extended inwardly, horizontal closure wall 233 could be positioned within thread ring 217, and thread ring 217 could be upwardly extended until it intersected the innermost edge of the inwardly extended horizontal closure wall 230.

Figure 5:
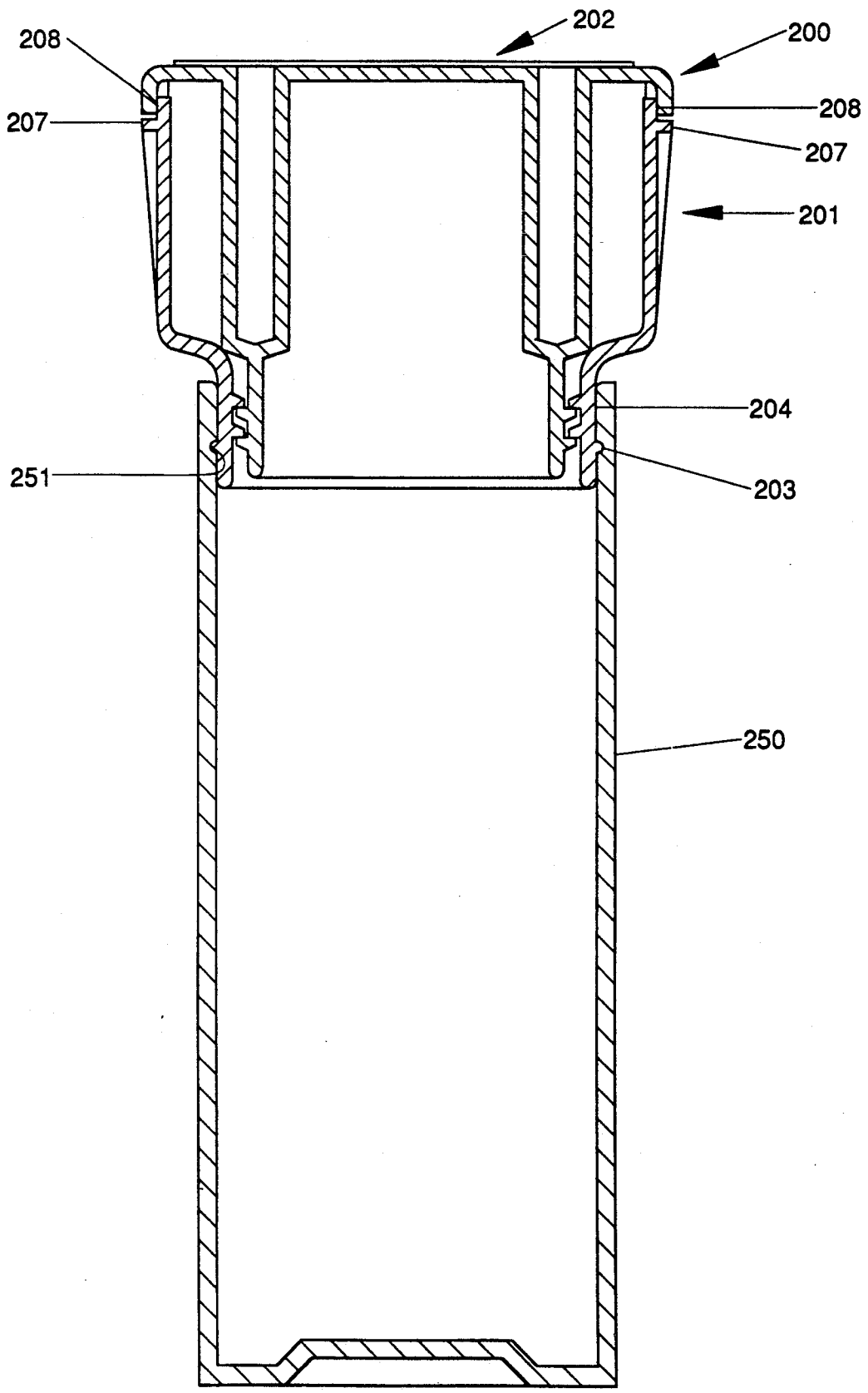
FIG. 5 is a cross-sectional view of a child resistant attachment of the type shown in FIGS. 4 and 4A assembled onto a cylindrical vial.

FIG. 5 is a cross-sectional view of child resistant attachment 200 assembled onto a cylindrical vial 250.

Attachment ring 204 is inserted into the open end of vial 250 and is secured in its assembled position by means of an external bead 203 which engages a groove 251 on the interior wall of vial 250. The resulting child resistant package provides the benefits of improved resistance to opening by children without significantly compromising access by adults to containers of the type commonly used by most pharmacists to dispense prescription medications. Because external bead 203 on attachment ring 204 and groove 251 in vial 250 permit unlimited rotation between the finish portion 201 of attachment 200 and the vial 250, child resistance of the resultant packages is enhanced even further, since rotation of the finish portion 201 of attachment 200 relative to vial 250 will not permit removal of closure 202. Furthermore, pharmacists' habits and practices regarding handling, filling and labeling are not significantly affected when child resistant attachments of the present invention are employed, since they are completely compatible with cylindrical vials.

Figure 6:
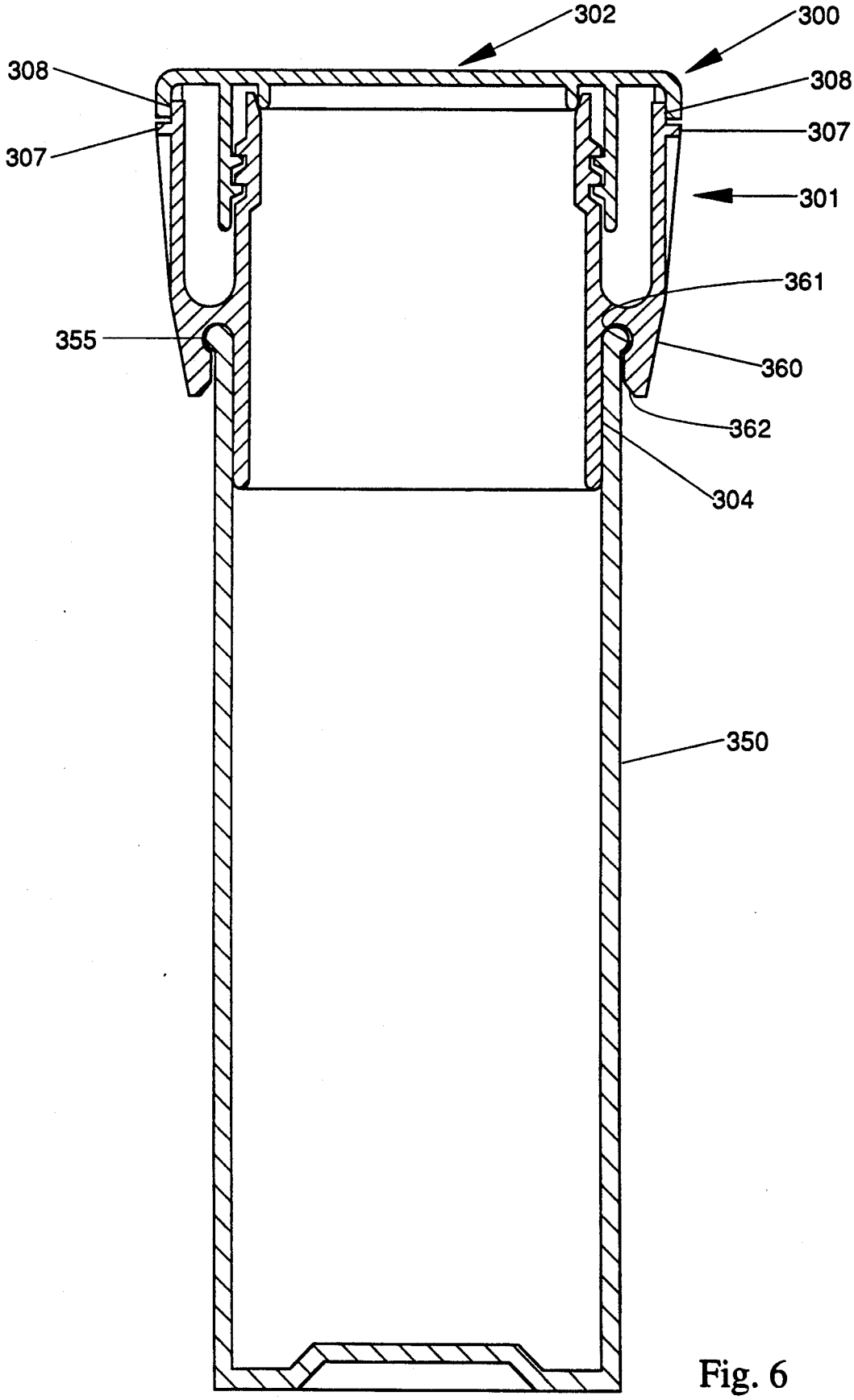
FIG. 6 is a cross-sectional view of another child resistant attachment of the present invention assembled onto a vial.

FIG. 6 is a cross-sectional view of another child resistant attachment 300 of the present invention assembled onto another cylindrical vial 350. Child resistant attachment 300 includes a pair of opposed resiliently deformable levers 307 having vertical extensions 308 and is generally similar in operation to child resistant attachment 100 shown in FIGS. 1–3A, but further includes a clamp collar 360. Clamp collar 360 comprises lead-in taper 362 and groove 361 for securing the attachment 300 to the cylindrical vial 350. Clamp collar 360 is generally concentric about attachment ring 304. Seal bead 355 at the opening of vial 350 is typical of most pharmaceutical vials currently used with simple snap caps. To assemble the attachment 300 onto the vial 350, attachment ring 304 of child resistant attachment 300 is inserted into the mouth of vial 350 and is pressed into place such that clamp collar 360 deflects outwardly as lead-in taper 362 encounters seal bead 355. Once fully assembled, groove 361 of attachment 300 substantially engages seal bead 355 of vial 350.

If desired, clamp collar 360 may be interrupted by slots which separate the clamp collar into several segments so that tougher polymers such as polycarbonate may be utilized without requiring excessive assembly force. Furthermore, one or more internal beads, such as bead 203 described for attaching child resistant attachment 200 to vial 250, can be added to reduce even further the chance that child resistant attachment 300 could be removed from vial 350 once full assembly of the attachment onto the vial has taken place.

Figure 7:
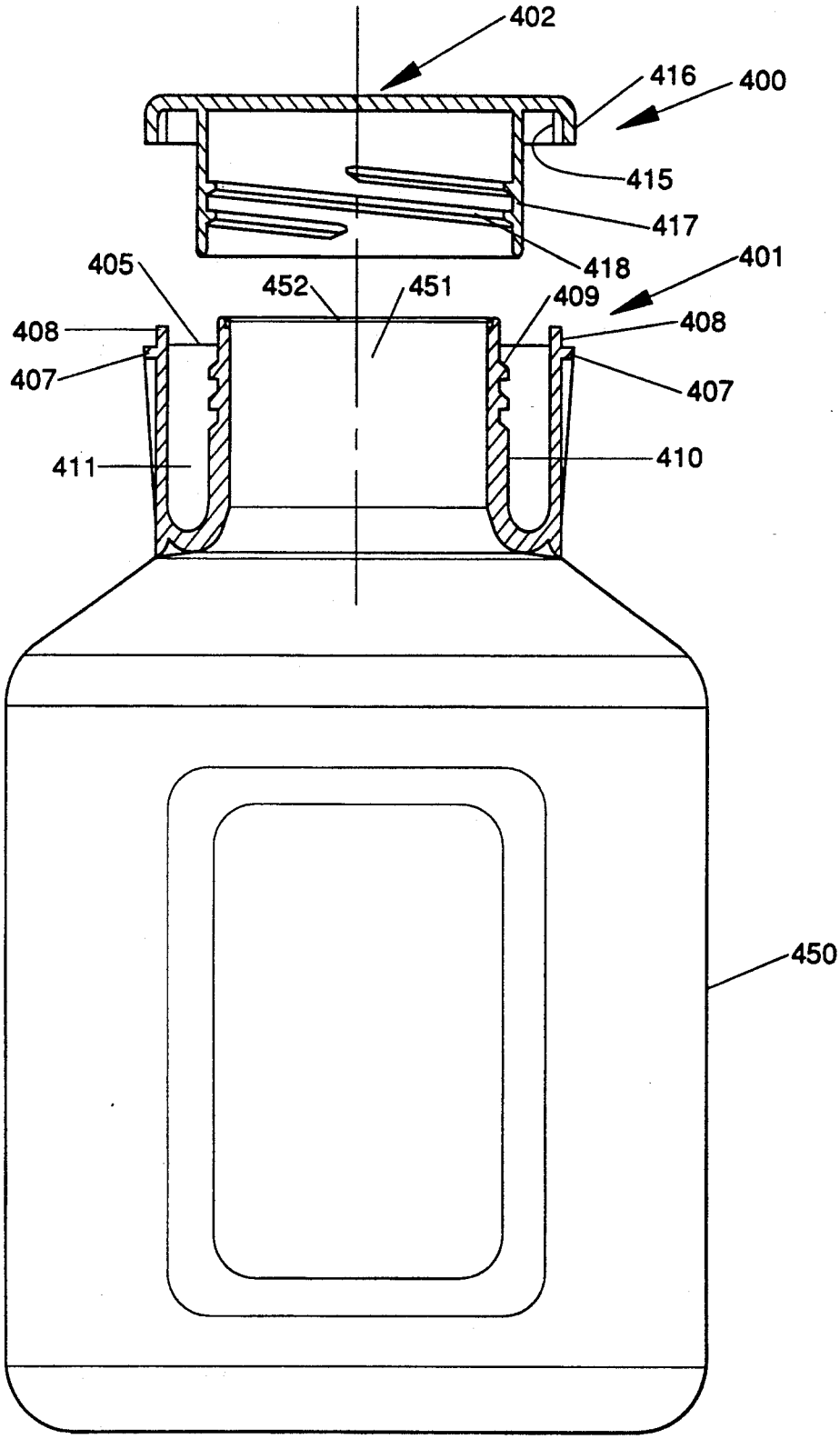
FIG. 7 is a cross-sectional view of another child resistant attachment of the present invention shown with its finish portion assembled onto a bottle.

FIG. 7 shows another alternative embodiment 400 of a child resistant attachment of the present invention. Child resistant attachment 400 is shown with its closure 402 unassembled to the finish portion 401. Closure 402 and finish portion 401 are shown in cross-section, while the front of bottle 450 is illustrated in FIG. 7. Finish portion 401 is shown assembled onto bottle 450. Below the neck ring 451, bottle 450 may be cylindrical or non-cylindrical, as desired. Neck ring 451 of bottle 450 extends within the inner surface of thread ring 410 and includes a catch bead 452 for retaining the finish portion 401 of child resistant attachment 400 on bottle 450. Threads 409 on the outermost surface of thread ring 410 are complementary to threads 418 on the innermost surface of thread collar 417 and provide means for releasably securing closure 402 to finish portion 401. The top of each spring like pushtab 407 has a vertical extension 408 which projects above the plane of the top edge of the tab ring or collar 405. A channel 411, formed between the innermost surface of tab collar 405 and the outermost surface of thread ring 410, accepts thread ring 417 when closure 402 is threaded onto finish portion 401. The opposed vertical extensions 408 interlock with pawls 415 on the innermost surface of lock ring 416 of closure 402 when the closure 402 is fully threaded onto finish portion 401. In general, the operation of child resistant attachment 400 is similar to that previously described for child resistant attachment 100.

Figure 8:
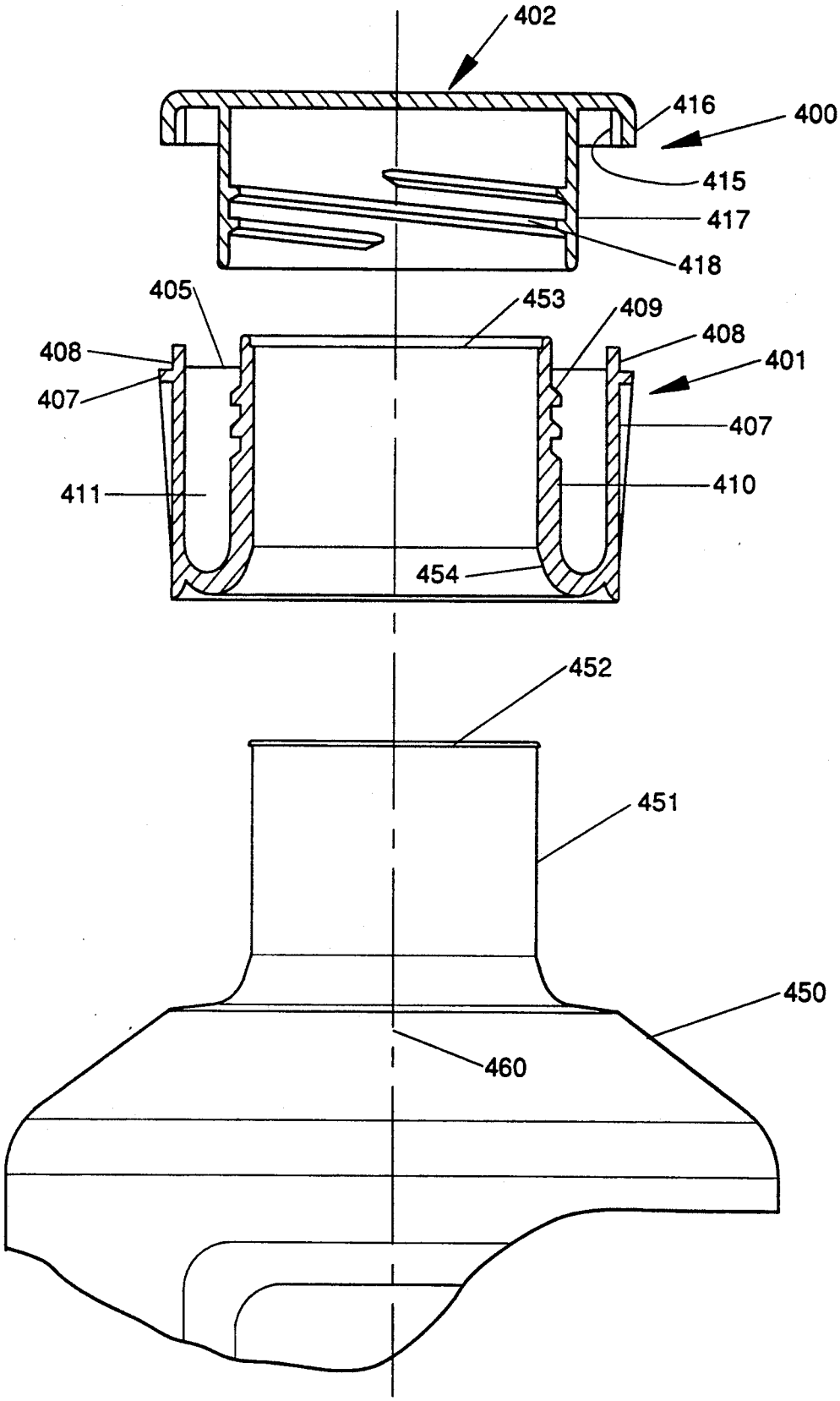
FIG. 8 is an enlarged cross-sectional view of the child resistant attachment shown in FIG. 7 prior to assembly of the finish portion onto the bottle.

FIG. 8 shows an enlarged exploded view of the unassembled child resistant attachment 400 prior to assembly of the finish portion 401 onto bottle 450. Neck ring 451 of bottle 450 includes a catch bead 452 which engages catch recess 453 at the upper end of the innermost surface of thread ring 410 when finish portion 401 is fully assembled onto neck ring 451. The diameter of catch bead 452 exceeds the diameter of the innermost surface of thread ring 410 at its juncture with catch recess 453. The interference between catch bead 452 and the upper innermost edge of thread ring 410 at catch recess 453 prevents removal of finish portion 401 from neck ring 451 of bottle 450. The tapered surface 454 on finish portion 401 facilitates insertion of neck ring 451 on bottle into finish portion 401.

The tapered surface 454 may, if desired, be extended even further up the innermost surface of thread ring 410 so that interference between catch bead 452 and the innermost surface of thread ring 410 occurs closer toward catch recess 453 to further facilitate assembly of the child resistant attachment 400 onto bottle 450.

If desired, limited clearance may also be provided between the innermost surface of thread ring 410 and the outermost surface of neck ring 451 while still maintaining sufficient interference between catch bead 452 on bottle 450 and catch recess 453 located at the upper innermost edge of thread ring 410 to prevent a child from removing the finish portion 401 from neck ring 451 of bottle 450. This enables the entire child resistant attachment 400 to be rotated relative to bottle 450 about axis 460. The ability to rotate the entire child resistant attachment 400 relative to bottle 450 further frustrates attempts by children to obtain access to the contents of the bottle 450 without appreciably compromising the ability of an adult having impaired strength, manual dexterity or both from gaining access to the package's contents. Although shown applied to a bottle in FIG. 7, rotatable attachment of a child resistant attachment of the present invention is not limited to bottles, but may be applied to nearly any other package form as well, e.g., pharmaceutical vials.

Figure 9A:
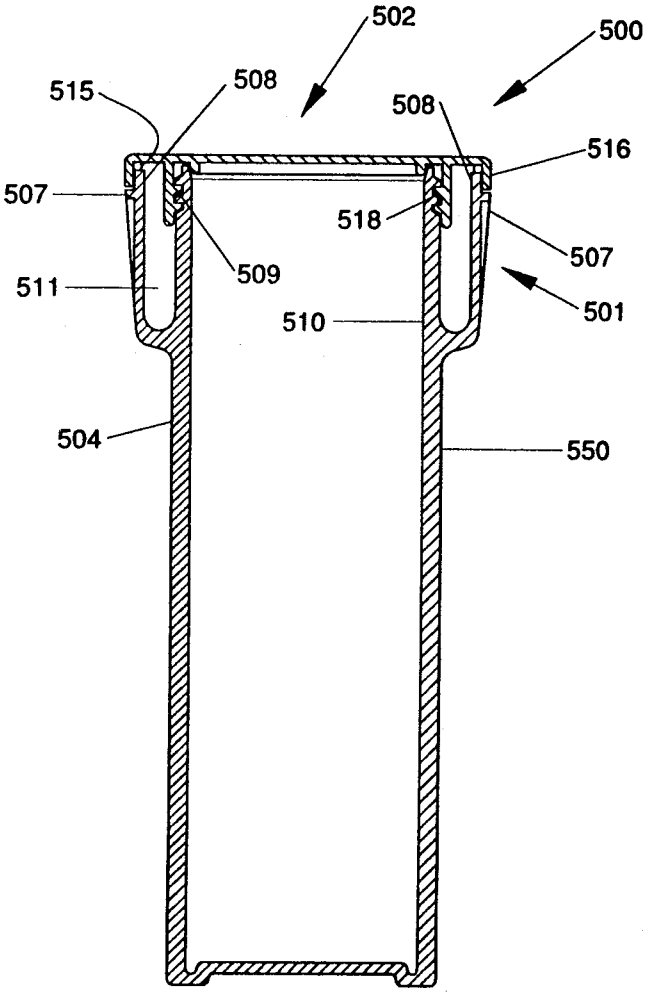
FIG. 9A is a cross-sectional view of the child resistant attachment and vial of FIG. 9.
Figure 9:
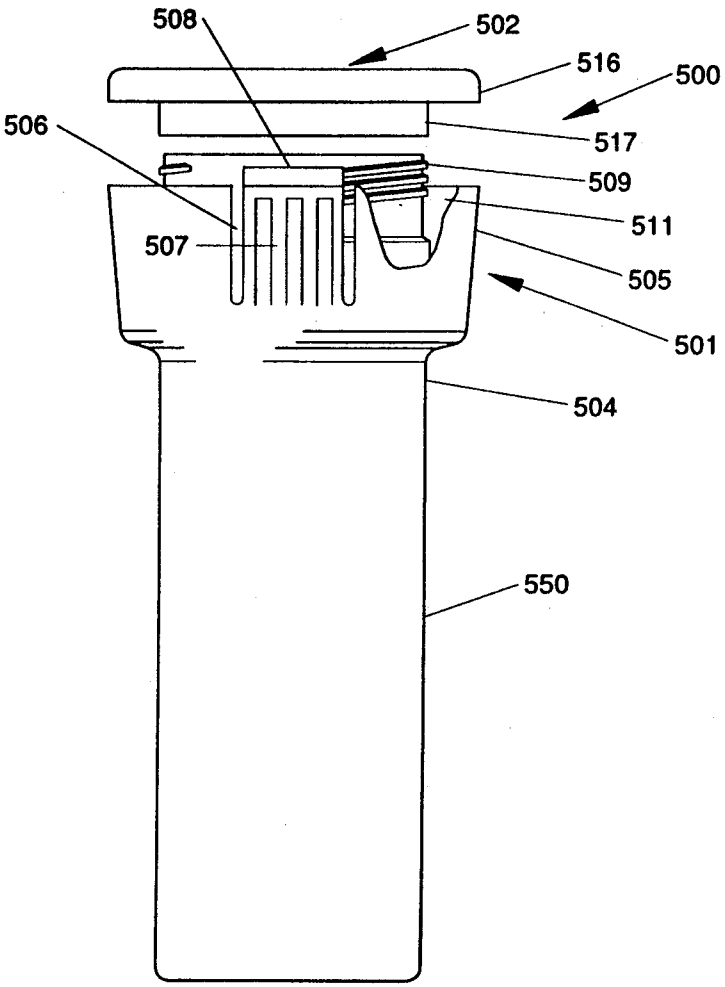
FIG. 9 is a side elevation view of a child resistant attachment of the present invention wherein the finish portion is integrally molded to a vial.

FIG. 9 is a partially segmented side elevation view of still another alternative embodiment 500 of a child resistant attachment of the present invention. However, as can be seen from FIGS. 9 and 9A, finish portion 501 of child resistant attachment 500 is integrally molded as a single component with vial 550. Closure 502 is shown unassembled from finish portion 501 in FIG. 9. A portion of the tab collar 505 is shown partially segmented to expose channel 511 which accepts thread collar 517 of closure 502. Tab ring or collar 505 is interrupted by slots 506 to form a pair of opposed cantilevered spring-like pushtabs 507. Pushtabs 506 have vertical extensions 508 which project above the plane of the upper surface of tab collar 505.

FIG. 9A shows a cross-sectional view of child resistant attachment 500 and vial 550 with closure 502 in a fully assembled condition, said view be taken through the opposed pushtabs 507. The lowermost end of attachment ring 504 is integrally molded to the uppermost end of vial 550. Complementary threads 509 and 518 on the outermost surface of thread ring 510 and the innermost surface of thread collar 517, respectively, secure closure 502 onto finish portion 501. Vertical extensions 508 interlock with pawls 515 on the innermost surface of lock ring 516. In general, operation of child resistant attachment 500 is similar to that described for child resistant attachment 100.

Figure 10A:
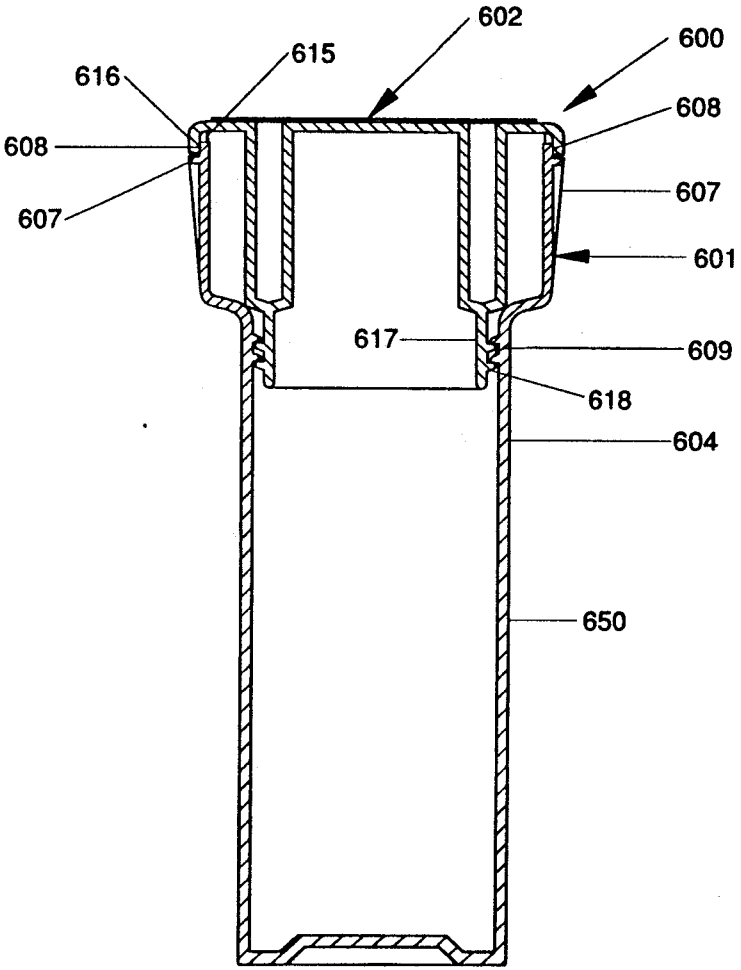
FIG. 10A is a cross-sectional view of the child resistant attachment and vial of FIG. 10.
Figure 10:
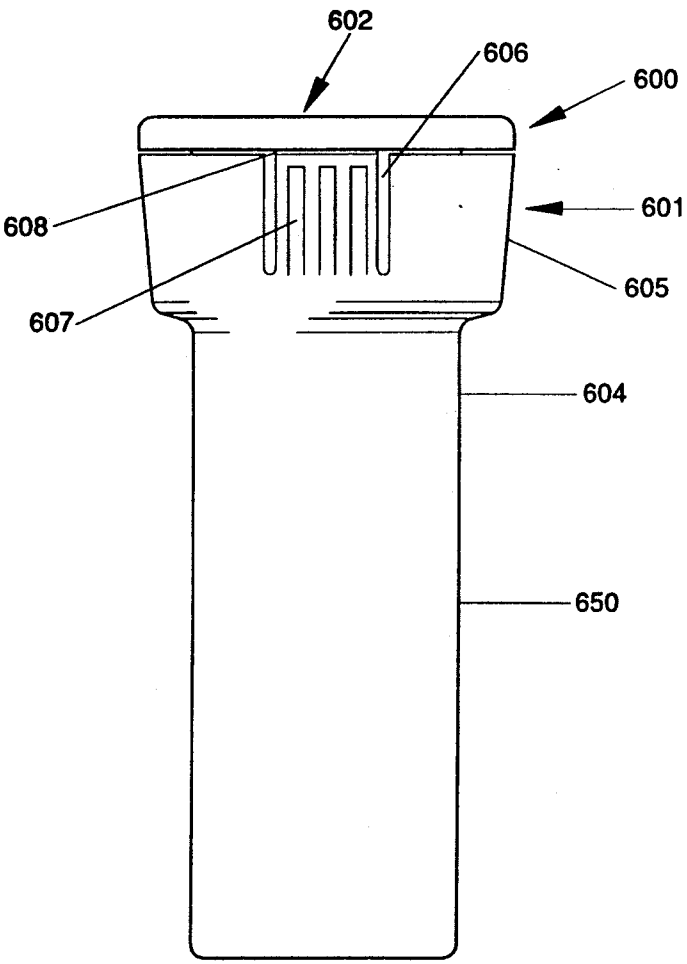
FIG. 10 is a side elevation view of another child resistant attachment of the present invention wherein the finish portion is integrally molded to a vial.

FIG. 10 shows a side elevation view of yet another alternative embodiment 600 of a child resistant attachment of the present invention. Again, finish portion 601 of child resistant attachment 600 is integrally molded with vial 650. Closure 602 is shown fully assembled with finish portion 601 in both FIGS. 10 and 10A. Tab collar 605 is interrupted by slots 606 to form a pair of opposed cantilevered spring-like pushtabs 607.

FIG. 10A shows a cross-sectional view of child resistant attachment 600 and vial 650 with closure 602 fully assembled onto finish portion 601, said view being taken through the opposed pushtabs 607. The lowermost end of attachment ring 604 is integrally formed with the uppermost end of vial 650. Complementary threads 609 and 618 on the innermost surface of attachment ring 604 and the outermost surface of thread ring 617, respectively, releasably secure closure 602 onto finish portion 601. Vertical extensions 608 interlock with pawls 615 on the innermost surface of lock ring 616, In general, operation of child resistant attachment 600 is similar to that described for child resistant attachment 200 shown in FIGS. 4 and 4A.

Figure 11A:
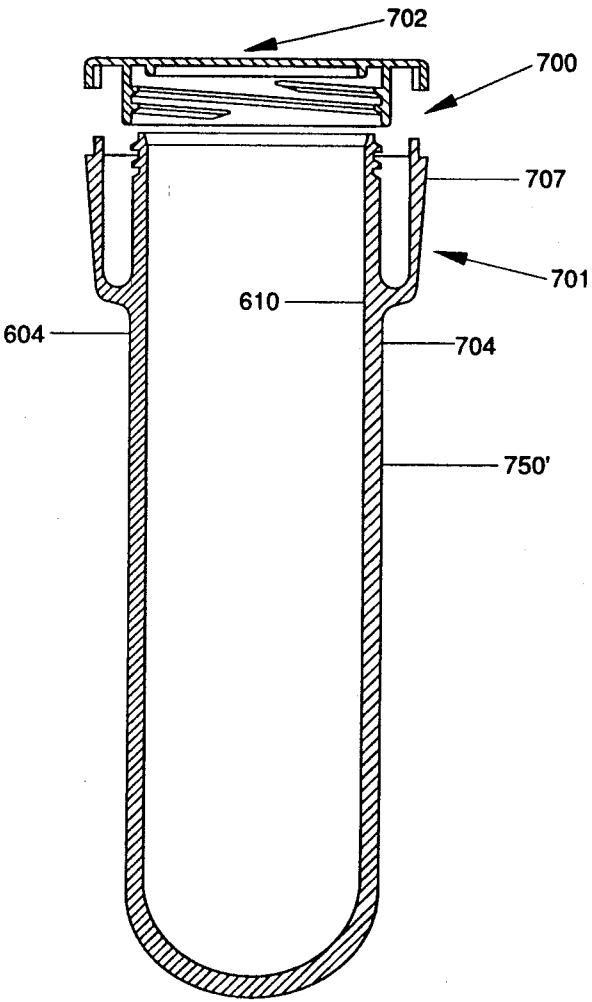
FIG. 11A is a cross-sectional view of the child resistant attachment shown in FIG. 11 wherein the finish portion of the child resistant attachment is integrally molded onto an injection molded preform which may thereafter be used to form the bottle of FIG. 11.
Figure 11:
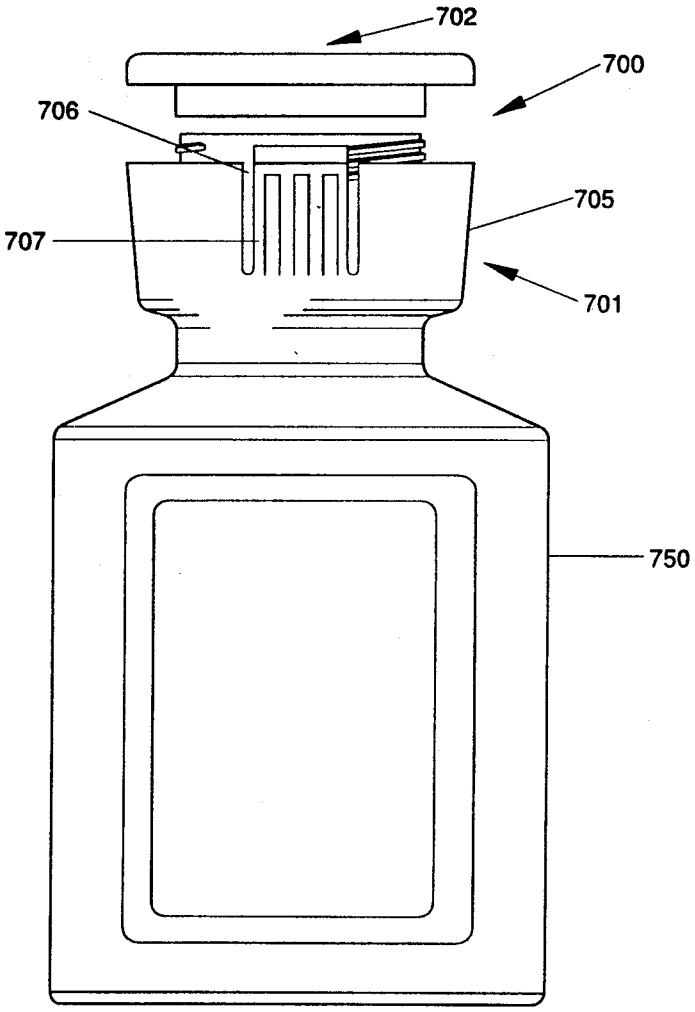
FIG. 11 is a side elevation view of still another child resistant attachment of the present invention wherein the finish portion is integrally molded to a bottle.

FIG. 11 shows a side elevation view of still another alternative embodiment 700 of a child resistant attachment of the present invention. As with the embodiments 500 and 600 of FIGS. 9 and 10, respectively, finish portion 701 of child resistant attachment 700 is integrally molded with bottle 750. Child resistant attachment 700 is shown in FIG. 11 with its closure 702 unassembled to finish portion 701. Operation of child resistant attachment 700 is generally similar to that described for child resistant attachment 100 shown in FIGS. 1-3A.

FIG. 11A shows a cross-sectional view of closure 702 unassembled from finish portion 701 and with the lowermost end of attachment ring 704 of finish portion 701 integrally molded to the uppermost end of a preform 750'. This represents an intermediate condition which occurs in the production process. Preform 750' is further processed by polymer processing means typically referred to as injection/blow molding or reheat/blow molding to form a finished bottle, such as the bottle 750, shown in FIG. 11.

Child resistant attachments of the present invention may be used with a variety of pharmaceutical or other containers. It is believed that the package designs and processes described herein and their attendant advantages will be understood from the foregoing description. It will, of course, be apparent to those skilled in the art that various changes may be made in form, construction, and arrangement without departing from the spirit and scope of the invention, and it is intended to cover in the appended claims all such modifications that are within the scope of this invention.

What is claimed is:

1. A child resistant attachment for a container suitable for storing and dispensing potentially dangerous material, said attachment being resistant to opening by children yet readily openable by adults, said child resistant attachment comprising:

(a) a finish portion having a closure securement ring, said closure securement ring having an innermost surface and an outermost surface, said closure securement ring including a first means for rotatably and releasably securing a closure to said closure securement ring on at least one of its surfaces, a downwardly extending attachment ring for attaching said finish portion to said container, and an annular collar having interior, exterior, uppermost and lowermost surfaces, said annular collar being generally concentrically aligned with said closure securement ring, interrupted by at least one pair of slots, thereby forming at least one resiliently deformable cantilevered pushtab having a lowermost end and an uppermost end, said push tab having an exposed surface contour which generally conforms to the contour of said exterior surface of the adjacent portions of said annular collar to minimize the chance of inadvertent depression thereof when said annular collar is grasped, said pushtab having a vertical extension projecting above said uppermost surface of said annular collar, said uppermost end of said pushtab being inwardly movable relative to the rest of said annular collar when a squeezing force is applied to said uppermost end of said pushtab; and (b) a closure having a first skirt having an innermost and an outermost surface, said first skirt including on at least one of its surfaces second means complementary to said first means for rotatably and releasably securing said closure to said closure securement ring on said finish portion and a second skirt external to first skirt, said second skirt having an innermost and an outermost surface, said closure also having at least one interlocking pawl on the innermost surface of said second skirt, said interlocking pawl being so shaped and positioned that it will deflect said vertical extension of said resiliently deformable pushtab when said closure is rotatably secured onto said finish portion, but will prevent removing said closure from said finish portion by rotating said closure in a reverse direction unless said resiliently deformable cantilevered pushtab on said annular collar is first depressed to disengage said pushtab vertical extension from said interlocking pawl.

2. The child resistant attachment of claim 1, wherein said attachment ring includes a securement means which mates with a corresponding securement means on said container so as to resist separation of said child resistant attachment from said container, especially by children, once said child resistant attachment is fully assembled onto said container.

3. The child resistant atachment of claim 2, wherein said securement means permits unlimited 360° rotation of said child resistant attachment relative to said container about a vertical axis passing through the center of said child resistant attachment while maintaining said finish portion securely attached to said container, thereby further frustrating attempts by children to gain access to the material in said container.

4. The child resistant attachment of claim 1, wherein said first and second means for rotatably and releasably securing said closure to said closure securement ring comprises complementary screw threads, wherein said annular collar includes two pairs of slots, thereby forming a pair of opposed resiliently deformable pushtabs having vertical extensions thereon and wherein said closure includes a pair of opposed pawls.

5. The child resistant attachment of claim 4, wherein the squeezing force required to depress said opposed resiliently deformable pushtabs a sufficient distance to disengage said vertical extensions from said interlocking pawls is in the range of about 0.5 to about 5 pounds.

6. A child resistant attachment for a container suitable for storing and dispensing potentially dangerous material, said attachment being resistant to opening by children yet readily openable by adults, said child resistant attachment comprising:

(a) a finish portion having an upwardly extending thread ring, said thread ring having an innermost surface and an outermost surface, said thread ring including external threads on said outermost surface of said thread ring, a downwardly extending attachment ring for attaching said finish portion to said container, and an annular collar having interior, exterior, uppermost and lowermost surfaces, said annular collar being generally concentric about said thread ring, interrupted by at least one pair of slots, thereby forming at least one resiliently deformable cantilevered pushtab having a lowermost end and an uppermost end, said push tab having an exposed surface contour which generally conforms to the contour of said exterior surface of the adjacent portions of said annular collar to minimize the chance of inadvertent depression thereof when said annular collar is grasped, said pushtab having a vertical extension projecting above said uppermost surface of said annular collar, said uppermost end of said pushtab being inwardly movable relative to the rest of said annular collar when a squeezing force is applied to said uppermost end of said pushtab; and (b) a closure having a first skirt having an innermost and an outermost surface said innermost surface of said first skirt including a means for rotatably and releasably securing said closure to said finish portion and a second skirt external to said first skirt, said second skirt having an innermost and an outermost surface, said closure also having at least one interlocking pawl on said innermost surface of said second skirt, said interlocking pawl being so shaped and positioned that it will deflect said vertical extension of said resiliently deformable pushtab when said closure is rotatably secured onto said finish portion, but will prevent removing said closure from said finish portion by rotating said closure in a reverse direction unless said resiliently deformable cantilevered pushtab on said annular ring is first depressed to disengage said pushtab vertical extension from said interlocking pawl.

7. The child resistant attachment of claim 6, wherein said attachment ring includes a securement means which mates with a corresponding securement means on said container so as to resist separation of said child resistant attachment from said container, especially by children, once said child resistant attachment is fully assembled onto said container.

8. The child resistant attachment of claim 7, wherein said securement means permits unlimited 360° rotation of said child resistant attachment relative to said container about a vertical axis passing through the center of said child resistant attachment while maintaining said finish portion securely attached to said container, thereby further frustrating attempts by children to gain access to the material in said container.

9. The child resistant attachment of claim 6, wherein said annular collar includes two pairs of slots, thereby forming a pair of opposed resiliently deformable pushtabs having vertical extensions thereon and wherein said closure includes a pair of opposed pawls.

10. The child resistant attachment of claim 9, wherein the squeezing force required to depress said opposed resiliently deformable pushtabs a sufficient distance to disengage said vertical extensions from said interlocking pawls is in the range of about 0.5 to about 5 pounds.

11. A child resistant attachment for a container suitable for storing and dispensing potentially dangerous material, said attachment being resistant to opening by children yet readily openable by adults, said child resistant attachment comprising:

(a) a finish portion having a closure securement ring, said closure securement ring having an innermost and an outermost surface, said closure securement ring including first means for rotatably and releasably securing a closure to said closure securement ring on at least one of its surfaces, means for securing said finish portion to said container, and an annular collar having interior, exterior, uppermost and lowermost surfaces, said annular collar being generally concentrically aligned with said closure securement ring, interrupted by at least one pair of slots, thereby forming at least one resiliently deformable cantilevered pushtab having a lowermost end and an uppermost end, said push tab having an exposed surface contour which generally conforms to the contour of said exterior surface of the adjacent portions of said annular collar to minimize the chance of inadvertent depression thereof when said annular collar is grasped, said pushtab having a vertical extension projecting above said uppermost surface of said annular collar, said uppermost end of said pushtab being inwardly movable relative to the rest of said annular collar when a squeezing force is applied to said uppermost end of said pushtab; and (b) a closure having a first skirt having an innermost and an outermost surface, said first skirt including on at least one of its surfaces second means complementary to said first means for rotatably and releasably securing said closure to said closure securement ring on said finish portion and a second skirt external to first skirt, said second skirt having an innermost and an outermost surface, said closure also having at least one interlocking pawl on the innermost surface of said second skirt, said interlocking pawl being so shaped and positioned that it will deflect said vertical extension of said resiliently deformable pushtab when said closure is rotatably secured onto said finish portion, but will prevent removing said closure from said finish portion by rotating said closure in a reverse direction unless said resiliently deformable cantilevered pushtab on said annular collar is first depressed to disengage said pushtab vertical extension from said interlocking pawl.

12. The child resistant attachment of claim 11, wherein said means for securing said finish portion to said container comprises an attachment ring including a securement means which mates with a corresponding securement means on said container so as to resist separation of said child resistant attachment from said container, especially by children, once said child resistant attachment is fully assembled onto said container.

13. The child resistant attachment of claim 12, wherein said securement means permits unlimited 360° rotation of said child resistant attachment relative to said container about a vertical axis passing through the center of said child resistant attachment while maintaining said finish portion securely attached to said container, thereby further frustrating attempts by children to gain access to the material in said container.

14. The child resistant attachment of claim 11, wherein said first and second means for rotatably and releasably securing said closure to said closure securement ring comprises complementary screw threads, wherein said annular collar includes two pairs of slots, thereby forming a pair of opposed resiliently deformable pushtabs having vertical extensions thereon and wherein said closure includes a pair of opposed pawls.

15. The child resistant attachment of claim 14, wherein the squeezing force required to depress said opposed resiliently deformable pushtabs a sufficient distance to disengage said vertical extensions from said interlocking pawls is in the range of about 0.5 to about 5 pounds.

* * * * *

UNITED STATES PATENT AND TRADEMARK OFFICE

CERTIFICATE OF CORRECTION

PATENT NO. : 5,230,433

DATED : July 27, 1993

INVENTOR(S) : Peter W. Hamilton et al

It is certified that error appears in the above-identified patent and that said Letters Patent is hereby corrected as shown below:

On title page, item [56] References Cited

"3,77,924" should read --3,777,924--

Col. 4, line 7, "an distinctly" should read -- and distinctly -- .

Col. 5, line 15, "in" should read -- is -- .

Col. 7, line 32, "205. attachment" should read -- 205. Attachment -- .

Col. 7, line 68, "pawls 214" should read -- pawls 215 -- .

Col. 8, line 2, after "finish" and before "taper" insert the following omitted words: -- portion 201, at which point seal lip 220 preferably engages finish -- .

Signed and Sealed this

Twenty-sixth Day of July, 1994

Bruce Lehman

*Attest:*

BRUCE LEHMAN

*Attesting Officer*

*Commissioner of Patents and Trademarks*